US005319923A

United States Patent [19]

Leonard et al.

[11] Patent Number: 5,319,923

[45] Date of Patent: Jun. 14, 1994

[54] AIR STAGED PREMIXED DRY LOW $NO_x$ COMBUSTOR

[75] Inventors: Gary L. Leonard, Cincinnati, Ohio; Shiro G. Kimura, Schenectady, N.Y.

[73] Assignee: General Electric Company, Schenectady, N.Y.

[21] Appl. No.: 26,228

[22] Filed: Feb. 26, 1993

Related U.S. Application Data

[63] Continuation of Ser. No. 764,298, Sep. 23, 1991, abandoned.

[51] Int. Cl.[5] ..... F23R 3/36

[52] U.S. Cl. ..... 60/39.23; 60/737

[58] Field of Search ..... 60/39.23, 737, 738, 60/739, 740, 741, 743, 744, 748, 749

[56] References Cited

U.S. PATENT DOCUMENTS 4,150,539 4/1979 Rubins et al. ..... 60/39.23
4,158,949 6/1979 Reider .
4,350,009 9/1982 Holzapfel .
4,587,809 5/1986 Ohmori et al. ..... 60/737
5,083,422 1/1992 Vogt ..... 60/752
5,121,608 6/1992 Willis et al. ..... 60/740

OTHER PUBLICATIONS

"Low Emission Combustor Design Options For An Aero Derived Industrial Gas Turbine" Owen et al., Canadian Gas Association Symposium on Industrial Application of Gas Turbines, Oct. 1991.

*Primary Examiner*—Richard A. Bertsch
*Assistant Examiner*—Timothy S. Thorpe
*Attorney, Agent, or Firm*—Paul R. Webb, II

[57] ABSTRACT

An air staged premixed dry low $NO_x$ combustor of the type that is constructed of a premixing chamber and a centerbody porous plug premixed flame stabilizer. Such structures of this type maintain very low flame temperatures and, ultimately, low $NO_x$ emissions.

7 Claims, 1 Drawing Sheet

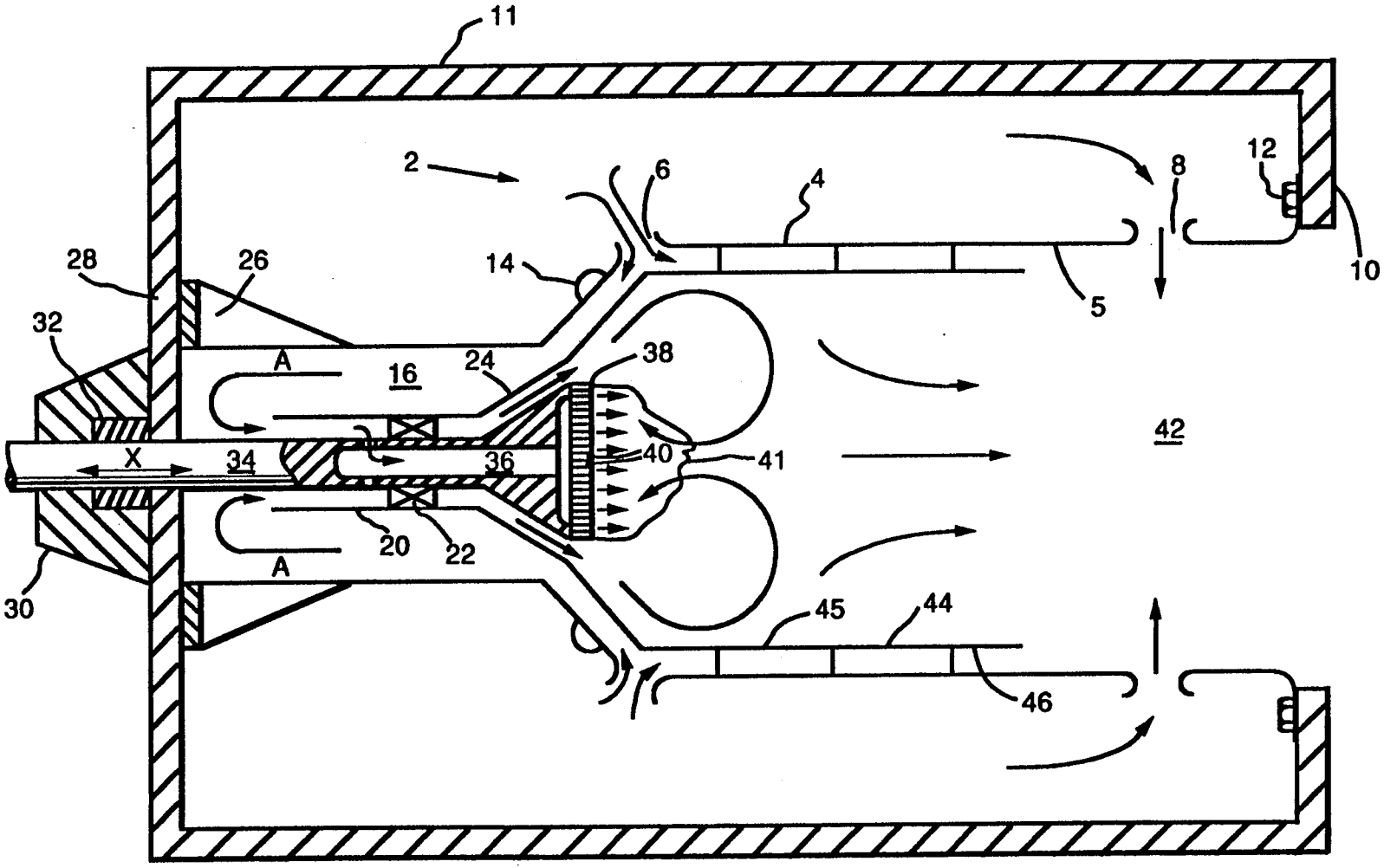
10
12
8
42
5
46
44
4
45
41
6
38
40
11
14
24
36
2
22
16
20
A
A
26
34
X
28
32
30

AIR STAGED PREMIXED DRY LOW $NO_x$ COMBUSTOR

This application is a continuation of application Ser. No. 07/764,298, filed Sep. 23, 1991, now abandoned.

CROSS-REFERENCE TO A RELATED APPLICATION

This application is related to commonly assigned U.S. patent application Ser. No. 07/764,297 (pending), to G. L. Leonard, entitled "An Air Staged Premixed Dry Low $NO_x$ Combustor With Venturi Modulated Flow Split".

BACKGROUND OF THE INVENTION

Field of the Invention

This invention relates to air staged premixed dry low $NO_x$ gas turbine combustors of the type that are constructed with a fuel/air premixing chamber and a centerbody porous plug premixed flame stabilizer. Such structures of this type achieve stable combustion over a wide range of fuel-to-air ratios and low flame temperatures in the combustor resulting in low emissions of nitrogen oxides ($NO_x$).

Description of the Related Art

It is known, in combustor systems, that in order to reduce $NO_x$ emissions, the flame temperature in the combustor must be reduced. A well known method of reducing the flame temperature is to premix the fuel and the air prior to the mixture being combusted. However, it is also known that a premixed combustor, typically, runs over a relatively narrow operation window which is determined by lean blow-out at low fuel/air ratios and high $NO_x$ emissions at high fuel/air ratios. Flame stability is very sensitive to fuel-to-air ratio and fuel/air velocity. For example, if the velocity of the mixture is too high, the flame in the combustor can be blown out. But, if the velocity is too low, the combustor flame may propagate backwards into the premixing area which is commonly referred to as flashback. Also, if the fuel-to-air ratio is not properly maintained and the flame temperature gets too high, the amount of $NO_x$ created will increase which is also highly undesirable. Therefore, a more advantageous premixed low $NO_x$ combustor, then, would be presented if the combustor could be run over a larger operation window. This is particularly important with regard to the operating range of the gas turbine.

It is apparent from the above that there exists a need in the art for a premixed low $NO_x$ combustor which is efficient through simplicity of parts and uniqueness of structure, and which at least equals the $NO_x$ emissions characteristics of known premixed combustors, but which at the same time can be run over a larger operation window. It is a purpose of this invention to fulfill this and other needs in the art in a manner more apparent to the skilled artisan once given the following the disclosure.

SUMMARY OF THE INVENTION

Generally speaking, this invention fulfills these needs by providing an air staged premixed low $NO_x$ combustor, comprising a combustion chamber means, a fuel introduction means, an air introduction means, a premixing chamber means located adjacent said fuel and air introduction means for mixing said fuel and said air, a fuel and air swirler means located adjacent said premixing chamber, a fuel/air control passage means located adjacent said swirler means, and a porous flame stabilizer means located adjacent said passage means and also located substantially within said combustion chamber.

In the preferred embodiment, air introduction into the combustor is comprised of air flow into the premixing chamber, cooling air, and dilution air. The distribution of air between the three inlets is determined by the axial location of an air valve, which also serves as a flame holder. The flame holder also incorporates a porous plate through which a small amount of fuel and air flow and acts as a pilot. Fuel enters the premixing chamber where it mixes with the primary combustion air prior to entering the combustion zone.

In another further preferred embodiment, the combustor is run over a larger operating window which maintains the flame temperature at a relatively low value over a larger range of fuel-to-air conditions which, in turn, provides low $NO_x$ emissions for this larger range of conditions.

The preferred air staged premixed combustor, according to this invention, offers the advantages of very low $NO_x$ emissions while achieving improved flame stability over a wide operating window.

BRIEF DESCRIPTION OF THE DRAWING

The above and other features of the present invention which will become more apparent as the description proceeds are best understood by considering the following detailed description in conjunction with the accompanying drawing, in which:

The single Figure is a side plan view of an air staged premixed dry low $NO_x$ combustor, according to the present invention.

DETAILED DESCRIPTION OF THE DRAWINGS

With reference to the single Figure, there is illustrated an air staged premixed dry low $NO_x$ combustor 2. Combustor 2 is constructed, in part, with outer shell 4, air control passage 6 and air dilution holes 8. Shell 4, preferably, is constructed of Hastelloy X alloy manufactured by International Nickel Company in Huntington, W. Va. A thin, heat resistant coating 5, preferably, of partially stabilized zirconia having a thickness of approximately 0.030 inches is applied to the inside surface of shell 4 by conventional coating techniques, such as, plasma spraying. Control passage 6 and holes 8 are used to admit air into premixing chamber 16 and combustion chamber 42, respectively, and cool air passage 44. The air, typically, is at a temperature of approximately 600°–1000° F. Shell 4 is rigidly attached to support 10 by conventional fasteners 12. Support 10, typically, is a wall of a pressurized enclosure 11 which encloses combustor 2.

A conventional gaseous fuel such as natural gas is introduced into combustor 2 by a conventional fuel manifold 14. Air which is introduced by control passage 6 and fuel which is introduced by manifold 14 are mixed in an annular premixing chamber 16. The premixed fuel/air then proceed along arrow A in a counterflow direction along annulus 20 to a counterflow axial flow swirler 22. This counterflow of the fuel/air mixture assures that the fuel and air are adequately mixed. Chamber 16 and annulus 20, preferably, are constructed of stainless steel. The fuel/air mixture is transported along annular combustion fuel/air mixture control passage 24 and proceeds out through passage 24 burned in flame 41. A part of the fuel air mixture also flows into the internal passage of the flame stabilizer and flows out into the combustion chamber through the pores 40 to act as a stable pilot for the main combustion fuel/air flow. It is to be understood that flame 41 located at stabilizer 38, is substantially a stabilized flame. Liner 46 which, preferably, is constructed of Hastelloy X alloy also includes a coating 45 which is the same coating as coating 5 on shell 4. Located between shell 4 and liner 46 is convectively cooled wall passage 44. In particular, air which is introduced by air control passage 6 proceeds towards chamber 16 and passage 44. The purpose of passage 44 is, as liner 46 is heated up due to the combustion of the fuel/air mixture in combustion chamber 42, the movement of air along passage 44 convectively cools liner 46. The air which proceeds along passage 44 is then introduced into combustion chamber 42 near dilution holes 8.

In order to reciprocate flame stabilizer 38, chamber 16 is rigidly attached to support 28 by a conventional flange 26. Support 28, typically, is another wall of the pressurized enclosure. Support 28 and flange 26, preferably, are constructed of stainless steel. A conventional actuator 34 is rigidly attached to post 36 of stabilizer 38. Actuator 34 reciprocates along direction of arrow X in packing 32 and packing retaining ring 30. Ring 30, preferably, is constructed of any suitable high temperature material. Packing seal 32, preferably, is constructed of graphite. Actuator 34 is attached to a conventional reciprocator (not shown).

During operation of combustion 2, the total amount of air which is introduced through air control passage 6 and dilution holes 8 remains relatively constant regardless of the amount of fuel added. Thus, it is important to divert some of the air away from chamber 16 and towards dilution holes 8 and passage 44, especially during reduced power conditions when the fuel demand is relatively low. If too much air is added to the fuel, the flame will become unstable and will extinguish. In order to properly maintain the correct air flow into premixing chamber 16, passage 44 and dilution holes 8, actuator 34 moves along the direction of arrow X which positions flame stabilizer 38 with respect to combustion fuel/air control passage 24. In particular, if stabilizer 38 is moved further away from passage 24, more air enters chamber 16 and less air enters holes 8 and passage 44. In this manner, more fuel must be added in order to keep a constant and fuel-to-air ratio through passage 24. As mentioned earlier, a constant fuel/air mixture is important to reducing $NO_x$ emissions. Also, the flame temperature is maintained at a relatively constant value over a larger operating window.

During reduced load operation, stabilizer 38 is moved by actuator 34 towards passage 24 such that less air enters the premixer 16 and more air enters dilution holes 8 and passage 44. In this manner, the flame temperature is maintained at a relatively constant value over a larger operating window. It is to be understood that under certain circumstances such as for especially low fuel demands, stabilizer 38 could be located substantially up against passage 24 such that the fuel/air mixture only flows through pores 38 in stabilizer 40.

Once given the above disclosure, many other features, modifications or improvements will become apparent to the skilled artisan. Such features, modifications or improvements are, therefore, considered to be apart of this invention, the scope of which is to be determined by the following claims.

What is claimed is:

1. An air staged premixed low $NO_x$ combustor, said combustor comprised of:

a combustion chamber means;

a fuel introduction means located adjacent to said combustion chamber means;

an air introduction means located adjacent to said fuel introduction means;

a premixing chamber means located adjacent said fuel introduction means for mixing said fuel and air;

a fuel and air swirler means located adjacent said premixing chamber means;

a fuel/air control passage means located adjacent said swirler means; and a porous flame stabilizer means located adjacent said passage means and also located substantially within said combustion chamber such that fuel and air pass through said porous flame stabilizer means.

2. The combustor, according to claim 1, wherein said combustion chamber is further comprised of:

a shell having a thermal barrier coating; and a liner having a thermal barrier coating wherein said liner is located adjacent to said shell.

3. The combustor, according to claim 1, wherein said fuel introduction means is further comprised of:

a fuel manifold means.

4. The combustor, according to claim 2, wherein said air introduction means is further comprised of:

an air passage means located adjacent to said fuel introduction means and which is regulated by the position of said flame stabilizer means; and an air flow dilution means located on said shell at a predetermined distance away from said air controller means.

5. The combustor, according to claim 1, wherein said premixing chamber means is annular.

6. The combustor, according to claim 1, wherein said passage means is adjustable.

7. The combustor, as in claim 1, wherein said stabilizer means is further comprised of:

an actuator means; and a porous plate means operatively connected to said actuator means.

* * * * *